US011592249B2

(12) United States Patent
Benedini et al.

(10) Patent No.: US 11,592,249 B2
(45) Date of Patent: Feb. 28, 2023

(54) FIREARM COMPRISING A SYSTEM FOR MOVING AMMUNITION FOR A FIREARM

(71) Applicant: LEONARDO S.P.A., Rome (IT)

(72) Inventors: Giordano Benedini, La Spezia (IT); Valter Benzoni, La Spezia (IT); Tiziano Bettelli, La Spezia (IT); Stefano Conti, La Spezia (IT); Mattia Forcina, La Spezia (IT); Enrico Sarioli, La Spezia (IT)

(73) Assignee: LEONARDO S.P.A., Rome (IT)

( * ) Notice: Subject to any disclaimer, the term of this patent is extended or adjusted under 35 U.S.C. 154(b) by 0 days.

(21) Appl. No.: 17/433,499

(22) PCT Filed: Feb. 24, 2020

(86) PCT No.: PCT/IB2020/051540
§ 371 (c)(1),
(2) Date: Aug. 24, 2021

(87) PCT Pub. No.: WO2020/174361
PCT Pub. Date: Sep. 3, 2020

(65) Prior Publication Data

US 2022/0187038 A1 Jun. 16, 2022

(30) Foreign Application Priority Data

Feb. 25, 2019 (IT) ..... 102019000002647

(51) Int. Cl.
*F41A 9/02* (2006.01)
*F41A 7/10* (2006.01)
*F41A 9/51* (2006.01)

(52) U.S. Cl.
CPC ..... *F41A 9/02* (2013.01); *F41A 7/10* (2013.01); *F41A 9/51* (2013.01)

(58) Field of Classification Search
CPC ..... F41A 7/08; F41A 7/10; F41A 9/02; F41A 9/29; F41A 9/30; F41A 9/50; F41A 9/51
(Continued)

(56) References Cited

U.S. PATENT DOCUMENTS 5,392,685 A * 2/1995 Stoner ..... F41A 7/10 89/13.05
7,669,512 B2 * 3/2010 Krause ..... F41A 9/02 89/33.5

(Continued)

FOREIGN PATENT DOCUMENTS

JP H07-174487 A 7/1995
JP H07-174488 A 7/1995
WO WO-2015026419 A2 * 2/2015 ..... F41A 9/30

OTHER PUBLICATIONS

International Search Report and Written Opinion for PCT/IB2020/051540 (dated Jun. 17, 2020).

(Continued)

*Primary Examiner* — Bret Hayes
(74) *Attorney, Agent, or Firm* — Merchant & Gould P.C.

(57) ABSTRACT

A system includes a movable assembly configured for pushing a piece of ammunition into a breech ring of a firearm and/or closing the breech ring, under control of a motor. A feeding device is configured for feeding the piece of ammunition into a position situated between the movable assembly and the breech ring. A synchronization device co-operates with the motor on one side and with the feeding device on the other side. The synchronization mechanism provides for selective transmission of motion, under control of the movable assembly, from the motor to the feeding mechanism, when the movable assembly is in a position away from the breech ring.

10 Claims, 6 Drawing Sheets

(58) Field of Classification Search
USPC ..... 89/33.16, 33.17, 33.25
See application file for complete search history.

(56) References Cited

U.S. PATENT DOCUMENTS

| | | | | |
|---|---|---|---|---|
| 8,833,226 | B2 | 9/2014 | Buhl | |
| 9,618,284 | B1 * | 4/2017 | Hoffman | F41A 7/08 |
| 10,352,638 | B1 * | 7/2019 | Day | F41A 9/50 |
| 10,871,336 | B1 * | 12/2020 | Johnston | F41F 1/10 |
| 2011/0120292 | A1 * | 5/2011 | Garwood | F41A 9/36<br>89/33.25 |

OTHER PUBLICATIONS

International Preliminary Report on Patentability for PCT/IB2020/051540 (dated Jun. 17, 2021).

* cited by examiner

FIREARM COMPRISING A SYSTEM FOR MOVING AMMUNITION FOR A FIREARM

This application is a National Stage Application of International Application No. PCT/IB2020/051540, filed Feb. 24, 2020, which claims benefit of Ser. No. 102019000002647, filed Feb. 25, 2019, in Italy and which applications are incorporated herein by reference. To the extent appropriate, a claim of priority is made to each of the above-disclosed applications.

TECHNICAL FIELD

The present invention relates to a firearm comprising a system for moving ammunition.

Background Art

In the artillery field, it is known to use firearms that typically comprise a breech ring for geometrically closing the firing chamber of the firearm when firing occurs. In particular, the breech ring is configured for receiving at the inlet a piece of ammunition to be fired. Generally, such firearms include a feeding device configured for feeding said piece of ammunition into a position situated between the movable assembly and the breech ring. There is also a barrel, through which the piece of ammunition is channeled by the breech ring after firing.

Several system types are known for controlling the moving of ammunition.

However, prior-art moving systems suffer from a number of drawbacks, which should desirably be overcome.

U.S. Pat. No. 8,833,226 B2 discloses a system wherein a combined breech and ammunition drive is provided for a breech of a weapon and/or for introducing ammunition by a feeding star using an external drive, wherein the respective drive is selectively engaged and disengaged. A selector drum that interacts with the drives has slots for the selective engagement and disengagement, and elements are guided in the slots, the slot moving component which engage into the drives in a form-fitted and force-closed manner and which can thereby engage and disengage same. The component being 3-way jaw clutches for example.

SUMMARY OF THE INVENTION

It is one object of the present invention to provide an improved firearm including a system for moving ammunition, which can overcome the drawbacks of the prior art.

According to the present invention, this and other objects are achieved through a firearm having an actuation system.

It is understood that the appended claims are an integral part of the technical teachings provided in the following detailed description of the present invention. In particular, the appended dependent claims define some preferred embodiments of the present invention that include some optional technical features.

Further features and advantages of the present invention will become apparent in light of the following detailed description, provided merely as a non-limiting example and referring, in particular, to the annexed drawings as summarized below.

DETAILED DESCRIPTION OF THE INVENTION

Figure 1:
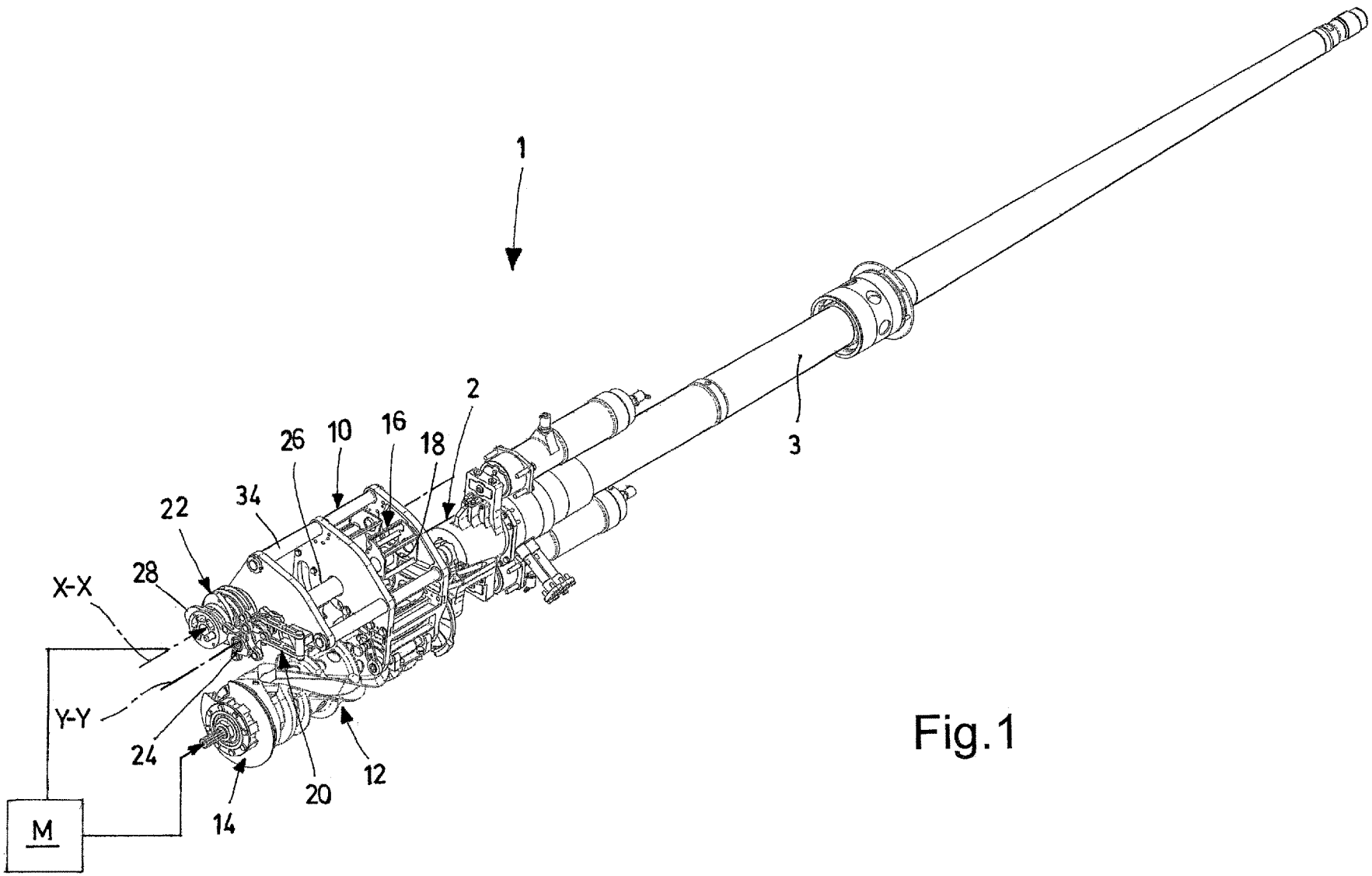
FIG. 1 is a perspective view of a firearm comprising a system for moving ammunition made in accordance with an exemplary embodiment of the present invention.
Figure 2:
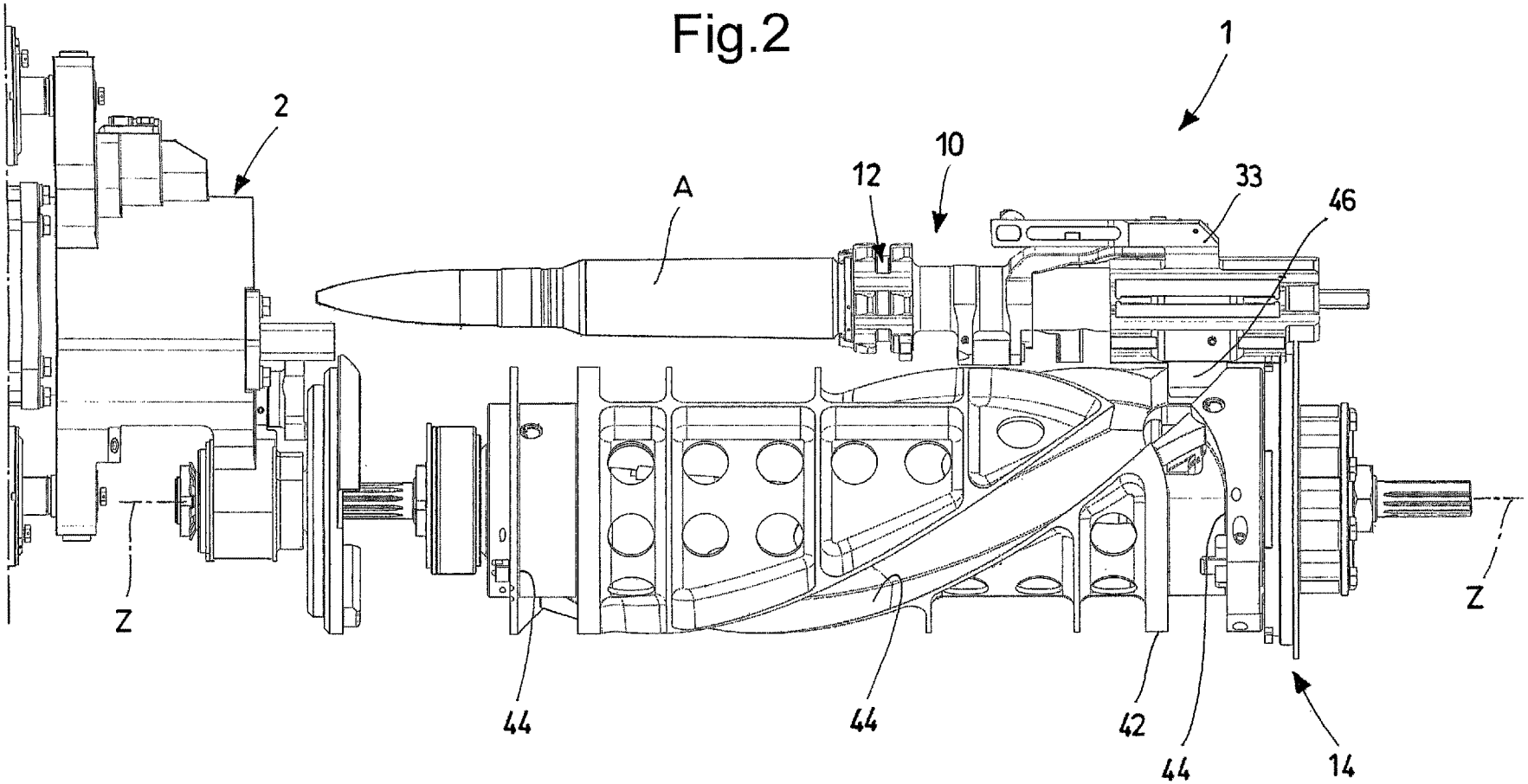
FIG. 2 is a magnified partial side elevation view of the firearm shown in FIG. 1, wherein a part of the moving system is visible.

With particular reference to FIGS. 1 and 2, numeral 1 designates as a whole a firearm intended to fire ammunition A. By way of example, firearm 1 is a single-barrel firearm.

Firearm 1 comprises a moving system 10 configured for moving ammunition A, made in accordance with an exemplary embodiment of the present invention.

In particular, moving system 10 is configured for handling ammunition A from a magazine (not numbered) to a breech ring 2 of firearm 1.

In a per se known manner, breech ring 2 is configured for receiving a piece of ammunition A (visible in particular in FIG. 4), e.g. a thirty-millimeter (30 mm) caliber shell, intended to be fired. Firearm 1 comprises a barrel 3, through which the piece of ammunition A is intended to be channelled when firing occurs.

With particular reference to FIG. 2, system 10 further comprises a movable assembly 12 controlled by a motor M (e.g. an electric motor of a per se known type). In the illustrated embodiment, movable assembly 12 is configured for pushing the piece of ammunition A into breech ring 2 and closing said breech ring 2, under control of motor M. In particular, the movement of movable assembly 12 between a position away or remote from breech ring 2 (FIG. 2) and an approached position of co-operation with said breech ring (FIG. 2*a*) is controlled by an actuation device 14 driven by motor M.

Preferably, but not necessarily, movable assembly 12 acts as a pusher member, for pushing the piece of ammunition A into breech ring 2, and also as a breechblock member, for closing the firing chamber of firearm 1 prior to firing said piece of ammunition A.

System 10 further comprises a feeding device 16 configured for feeding the piece of ammunition A between movable assembly 12 and breech ring 2. Preferably, feeding device 16 is also configured for discharging the fired shell case, in particular simultaneously with the feeding of a new piece of ammunition.

Figure 6:
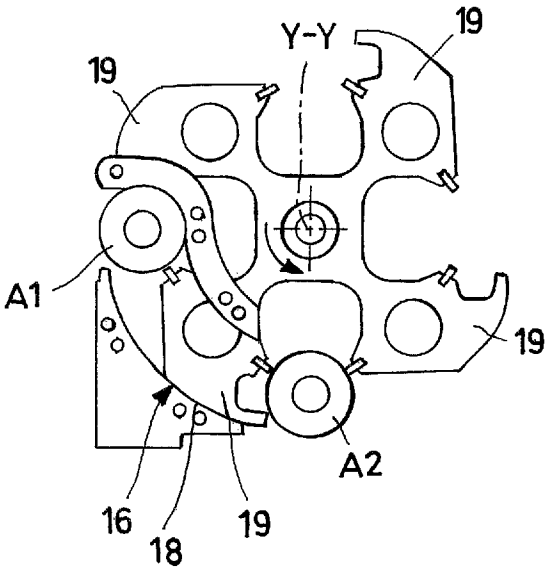
FIG. 6 is a magnified rear elevation view showing only the feeding device depicted in FIG. 5.
Figure 5:
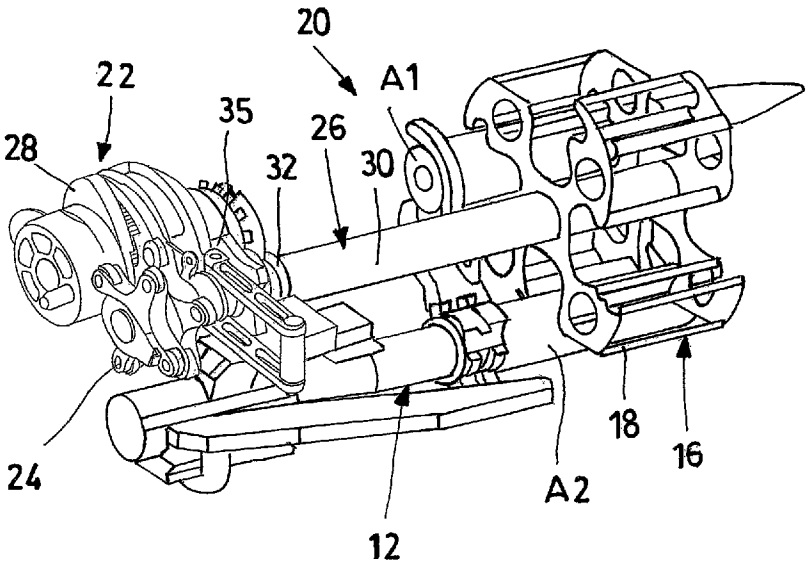
FIG. 5 is a perspective view similar to FIG. 3, though it does not show an intermitter supporting frame. Also, this figure provides a better view of the feeding device, e.g. including a star loader, which carries two pieces of ammunition in two different positions.

In the illustrated embodiment, the feeding device is a rotary one and comprises, by way of example, a star loader 18. Preferably, star loader 18 has a rotatable structure with a plurality of radial arms 19. Particularly, during a rotation movement (counterclockwise when viewing FIG. 6) of star loader 18, each radial arm 19 can take, in turn, one piece of ammunition from the respective magazine (see the piece of ammunition designated as A1 in FIGS. 5 and 6) and bring it into a position between movable assembly 12 and breech ring 2, where it is ready for starting the pressing and firing phase. At the same time, during the same rotation movement adjacent radial arm 19 can discharge any shell case that may be present at the end of the previous firing phase (see the piece of ammunition designated as A2 in FIGS. 5 and 6), moving it sideways away from the position between movable assembly 12 and breech ring 2.

Figure 2A:
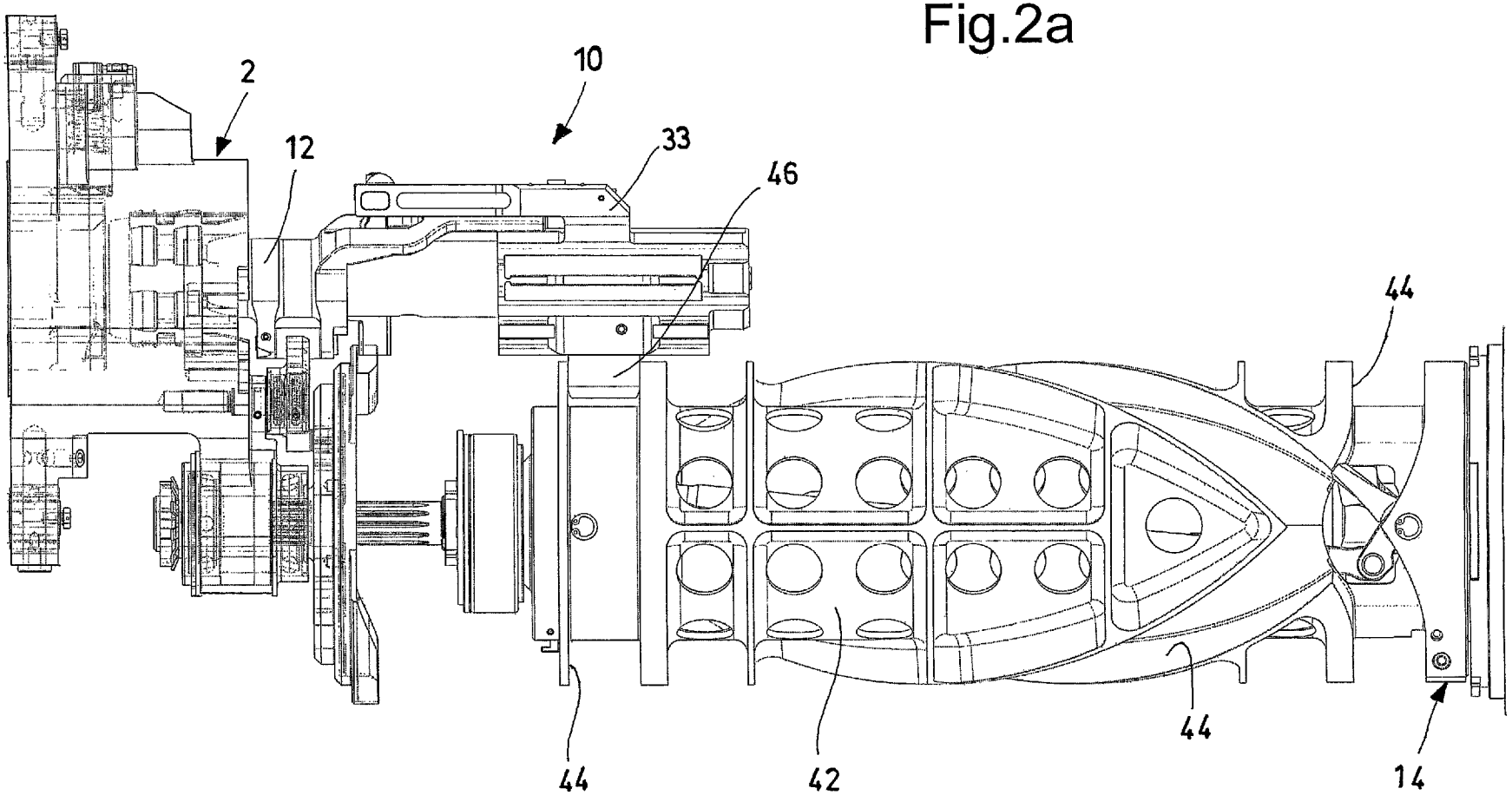
FIG. 2*a* is a view similar to FIG. 2, wherein the firearm is in a different operating condition.

Furthermore, system 10 includes a synchronization mechanism 20 co-operating with motor M on one side and, on the other side, with feeding device 16. Synchronization mechanism 20 selectively allows, under control of movable assembly 12, for controlled transmission of motion from motor M to feeding device 16. The engagement between motor M and feeding device 16 is permitted by synchronization mechanism 20 when movable assembly 12 is in a position away from breech ring 2 (FIG. 2*a*). In this condition, the piece of ammunition A to be fired can be loaded (while also discharging any shell case), which will then be pushed into breech ring 2.

In other terms, in operation synchronization mechanism 20 is kept normally disengaged (e.g. by elastic means, as will be described hereinafter), thus preventing the transmission of motion between motor M and feeding device 16. Said synchronization mechanism 20 is engaged, so that motion can be transmitted from motor M to feeding device 16, when the movable assembly is in the position remote from breech ring 2.

In the illustrated embodiment, as schematically shown in FIG. 1, motor M simultaneously co-operates with movable assembly 12 and with synchronization mechanism 20 to rotatably drive them both. In particular, there is an appropriately sized transmission (e.g. a gear train) interposed between motor M and movable assembly 12 (through the associated actuation device 14) and synchronization mechanism 20. In this manner, there is preferably a single motor M capable of controlling the motion of movable assembly 12 and of feeding device 16.

Preferably, synchronization mechanism 20 comprises an intermitter 22 configured for converting a continuous rotation of motor M into an intermittent rotation of feeding device 16. More in detail, intermitter 22 comprises a driven part rotatably integral with feeding device 16, and a driving part configured to be rotatably actuated by motor M and to co-operate with the driven part in order to transfer an intermittent motion to the driven part.

In particular, the driven part is rotatably integral with a rotary element of feeding device 16 and rotatable about an axis of rotation Y-Y. On the contrary, the driving part is rotatably actuated by motor M about an axis of rotation X-X through suitable transmission means (e.g. meshing toothed wheels).

In the illustrated embodiment, the driven portion comprises a pair of roller plates 24, and said rotary element is implemented substantially as a shaft 26, whereon said roller plates 24 are mounted. For example, roller plates 24 are axially spaced apart and angularly offset.

In the illustrated embodiment, the driving part comprises a pair of cams 28 configured to be rotatably actuated about an axis of rotation X-X by motor M, each one of them co-operating with a respective roller plate 24. Like roller plates 24, the cams are axially spaced apart and the eccentricities of cams 28 are angularly offset.

Cams 28 rotatably push respective roller plates 24, and associated shaft 26, when movable assembly 12 is in a position away or remote from breech ring 2. In further variant embodiments not illustrated herein, it may be envisaged that the intermitter comprises only one roller plate and only one cam co-operating with said roller plate.

Figure 4:
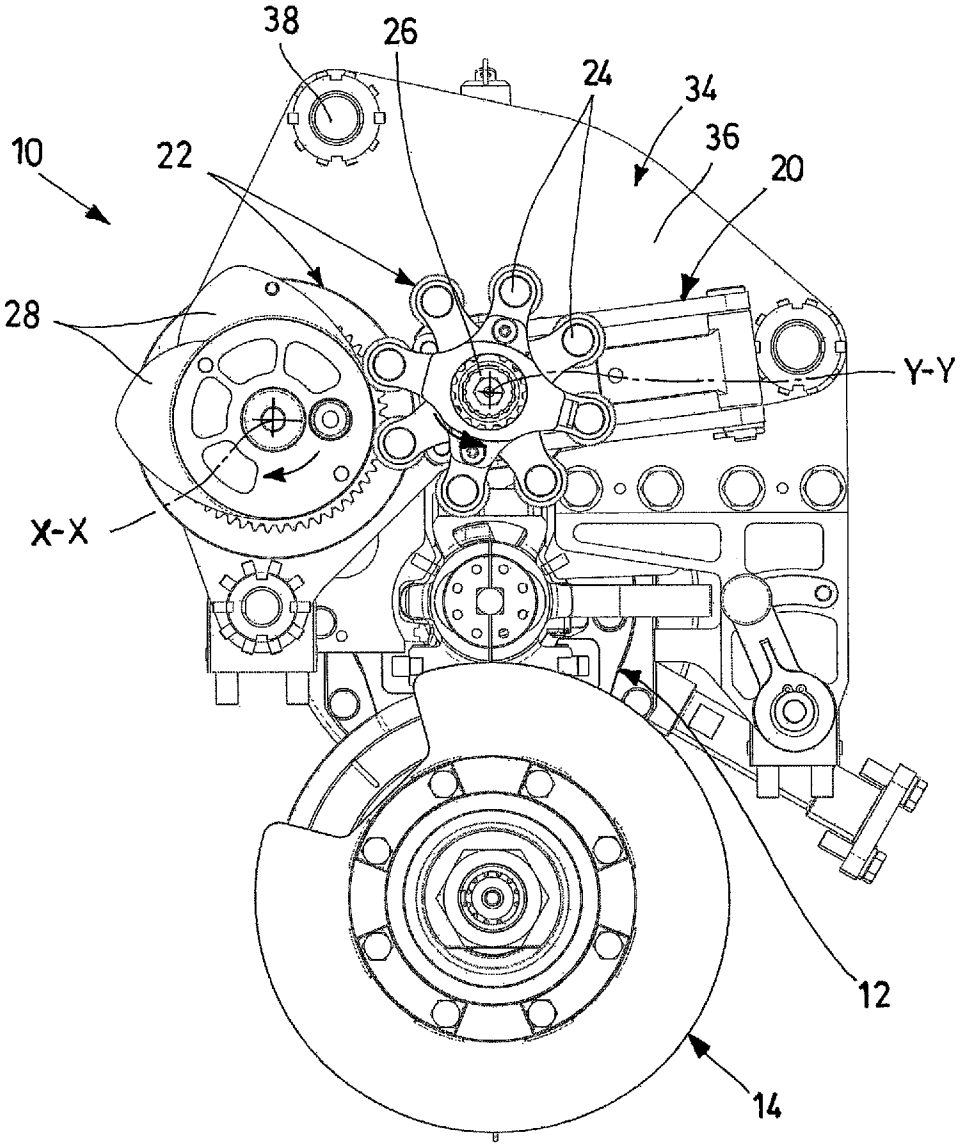
FIG. 4 is a magnified rear elevation view of the firearm shown in FIG. 1, wherein the above-mentioned moving system is better visible.

In particular, motor M imparts a continuous rotary motion to cams 28 (clockwise when viewing FIG. 4). In turn, cams 28 are configured to rotatably actuate roller plates 24, transferring thereto an intermittent rotary motion (counterclockwise when viewing FIG. 4). More in detail, the eccentric profiles of cams 28 thrustably engage the periphery of roller plates 24 for only a part of the rotary motion of said cams 28.

In the illustrated embodiment, movable assembly 12 is configured for mutually moving and bringing closer to each other (through actuation device 14) pair of roller plates 24 and respective cams 28, for the purpose of selectively engage roller plates 24 and cam 28 when movably assembly 12 is in a position away from breech ring 2.

Preferably, movable assembly 12 is configured for causing (through actuation device 14) roller plates 24 to translate along the axis of rotation Y-Y of shaft 26 from an idle position (shown in FIGS. 3 and 5) to an active position. In the active position, cams 28 flank and co-operate with roller plates 24. In the idle position, cams 28 are axially offset relative to roller plates 24 and therefore cannot co-operate with said roller plates 24; thus, in said idle position roller plates 24 and cams 28 are mutually unconstrained in rotation. In this way, in the idle position feeding device 16 is prevented from loading the piece of ammunition A; this condition prevents any undesired feeding of the piece of ammunition A when movable assembly 12 is co-operating with breech ring 2 during the pressing and firing phase of the firearm.

The axis of rotation Y-Y of roller plates 24 and of shaft 26 rotatably integral therewith is substantially parallel to the axis of rotation X-X of cams 28.

In the illustrated embodiment, roller plates 24 are coupled to shaft 26 by means of a telescopic coupling.

In the illustrated embodiment, shaft 26 comprises a first portion 30 (e.g. a first shaft section) rotatably co-operating with feeding device 16. Shaft 26 comprises also a second portion 32 (e.g. a second shaft section), whereon roller plates 24 are mounted. The second portion 32 is translatably movable and rotatably integral with the first portion 30.

In particular, movable assembly 12 comprises an engagement element, e.g. a protrusion 33, configured for causing roller plates 24 to translate from the idle position to the active position when movable assembly 12 moves into the position remote from breech ring 2. For example, when the movement into said remote position occurs, engagement element or protrusion 33 abuts against a portion of shaft 26 or directly against roller plates 24, and pushes them along into their active position, preferably against the action of elastic means (of a per se known type and not shown) tending to keep roller plates 24 in the idle position.

Preferably, the first portion 30 and the second portion 32 of shaft 26 are kept close to each other by said elastic means, thus tending to maintain roller plates 24 in the idle position; movable assembly 12 acts against the action of said elastic means, moving the first portion 30 and associated roller plates 24 away from the second portion 32 and so into the active position when said movable assembly 12 is in the position remote from breech ring 2.

By way of example, movable assembly 12 may be configured for abutting (in particular, with engagement element or protrusion 33) on a striker element, e.g. a flange 35, carried by shaft 26. In particular, striker element or flange 35 is carried by the first portion 30 of shaft 26, roller plates 24 being translatably and rotatably integral with the first portion 30 of shaft 26.

In the illustrated embodiment, system 10 comprises also a frame 34 configured for rotatably supporting synchronization mechanism 20, in particular intermitter 22. More in particular, frame 34 rotatably supports shaft 26 (which is rotatably integral with roller plates 24 and feeding device 16) and cams 28.

Figure 3:
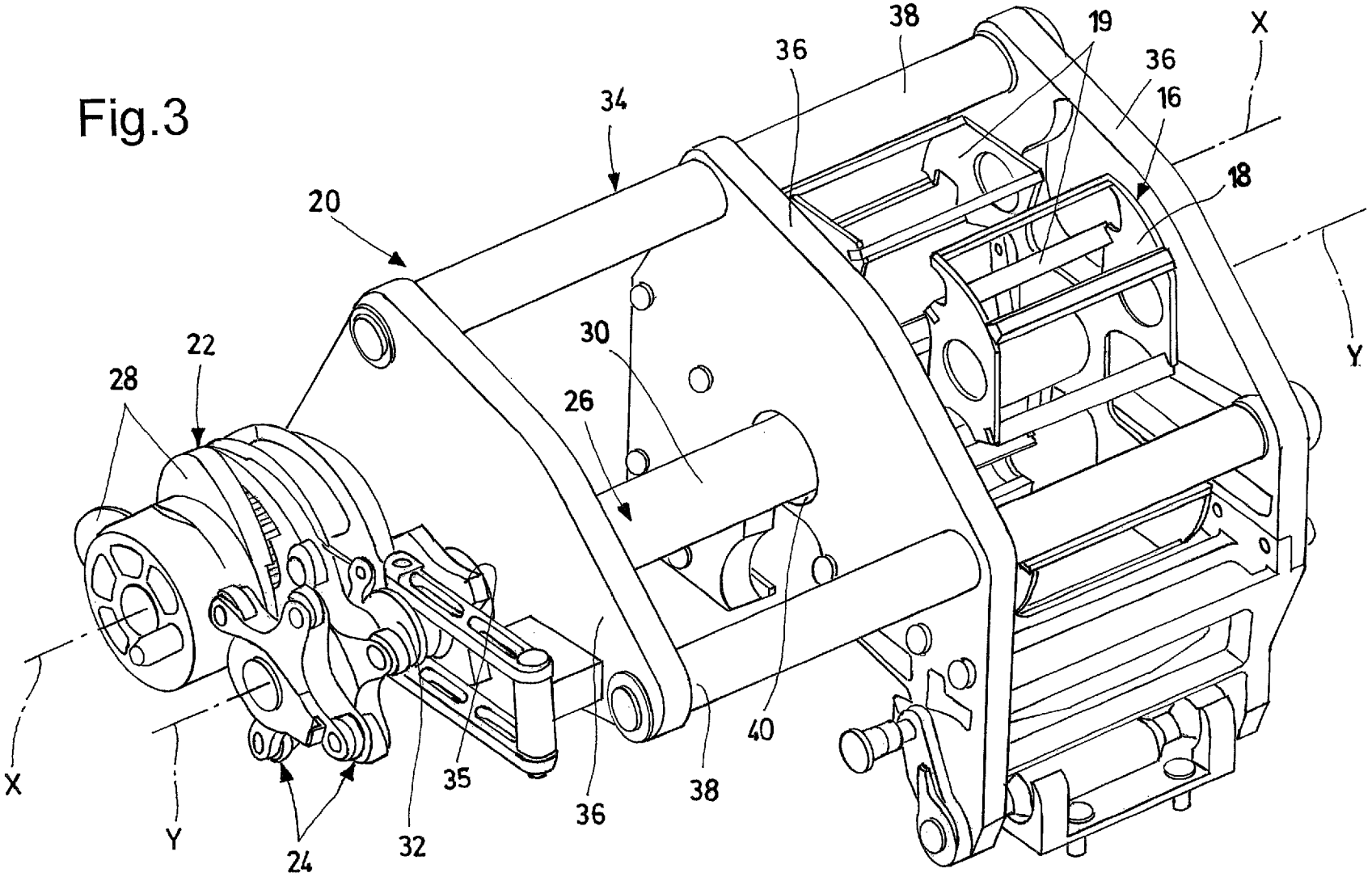
FIG. 3 is a magnified perspective view of a part of the moving system shown in the preceding figures.

In the illustrated embodiment, with particular reference to FIG. 3, frame 34 is implemented substantially as a framework supporting synchronization mechanism 20. In particular, frame 34 comprises a plurality of plates 36 connected by longitudinal beams 38, in particular at the perimeter of said plates 36.

For example, each one of plates 36 has a respective aperture 40 configured to be crossed by and rotatably support shaft 26.

In the illustrated embodiment, system 10 comprises a linear guide of a per se known type (not shown), whereon movable assembly 12 is configured to slide linearly.

In the illustrated embodiment, actuation system 14 comprises also a cylindrical drum 42 configured to be rotatably actuated about a central axis Z-Z by motor M, of a per se known type.

Cylindrical drum 42 co-operates with movable assembly 12 to control the movement of movable assembly 12 along said linear guide between:

the position away or remote from breech ring 2, shown in FIG. 2, for the phases of loading the piece of ammunition A and for discharging any shell case prior to pressing the piece of ammunition A towards breech ring 2, and the approached position of co-operation with breech ring 2, shown in FIG. 2*a*, for the phases of firing the loaded piece of ammunition.

In the illustrated embodiment, cylindrical drum 42 is substantially a positive-control multi-revolution cam.

The outer surface of cylindrical drum 42 defines an external groove 44 in which a pin 46 is coupled, carried by movable assembly 12. Therefore, during the rotation of cylindrical drum 42, the co-operation between groove 44 and pin 46 results in the reciprocating motion of movable assembly 12.

Of course, without prejudice to the principle of the present invention, the forms of embodiment and the implementation details may be extensively varied from those described and illustrated herein merely by way of non-limiting example, without however departing from the scope of the invention as set out in the appended claims.

By way of non-limiting example, as will be apparent to a person skilled in the art, the driven part and the driving part of the intermitter may be implemented by using elements different from roller plates 24 and cams 28 described in the illustrated embodiment.

It will also be apparent to a person skilled in the art that feeding device 16 may be implemented by means of structures different from star loader 18 described in the illustrated embodiment.

The invention claimed is:

1. A firearm comprising a system for moving ammunition; said system comprising:

a movable assembly configured for pushing a piece of ammunition into a breech ring of said firearm and/or closing said breech ring, under control of a motor;

a feeding device configured for feeding said piece of ammunition into a position situated between said movable assembly and said breech ring, and comprising a star loader having a rotatable structure provided with radial arms; and a synchronization mechanism co-operating, on one side, with said motor and, on the other side, with said feeding mechanism; said synchronization mechanism allowing for selective transmission of motion, under control of said movable assembly, from said motor to said feeding mechanism, when said movable assembly is in a position away from said breech ring;

wherein said synchronization mechanism comprises an intermitter comprising:

a driven part rotatably integral with a rotary element of said feeding mechanism; and a driving part configured to be rotatably actuated by said motor and to intermittently transfer said rotation to said driven part, when said movable assembly is in a position away from said breech ring;

wherein said rotary element is implemented substantially as a shaft supporting said radial arms of said star loader; and wherein an axis of rotation of said shaft is parallel to an axis of rotation of said driving part;

wherein said movable assembly is configured for moving said driven part and said driving part closer to each other, selectively engaging said driven part and said driving part when said movable assembly is in a position away from said breech ring.

2. The firearm according to claim 1, wherein said movable assembly is configured for laterally aligning said driven part and said driving part.

3. The firearm according to claim 2, wherein said movable assembly is configured for moving said driven part along the axis of rotation of said shaft from an idle position, in which said driven part is axially offset relative to said driven part, to an active position, in which said driving part substantially flanks and co-operates with said driven part.

4. The firearm according to claim 1, wherein said driven part is coupled to said shaft via a telescopic coupling.

5. The firearm according to claim 4, wherein said shaft comprises:

a first portion rotatably co-operating with said feeding device, and a second portion whereon said driven part is mounted, said second portion being translatably movable and rotatably integral relative to said first portion.

6. The firearm according to claim 1, further comprising a frame configured for rotatably supporting said driven part, said shaft, and said driving part.

7. The firearm according to claim 1, wherein said driven part comprises at least one roller plate.

8. The firearm according to claim 7, wherein said driving part comprises at least one cam configured for rotatably pushing said roller plate when the movable assembly is in a position away from said breech ring.

9. The firearm according to claim 1, wherein said movable assembly is controlled by an actuation device driven by the motor.

10. The firearm according to claim 9, further comprising a cylindrical drum configured to be rotatably actuated by the motor and co-operating with the movable assembly.

* * * * *